US009599426B2

(12) United States Patent
Darlington

(10) Patent No.: US 9,599,426 B2
(45) **Date of Patent: *Mar. 21, 2017**

(54) CROSSBOW WITH IMPROVED RAIL AND ARROW SLOT

(71) Applicant: Rex F. Darlington, Whittemore, MI (US)

(72) Inventor: Rex F. Darlington, Whittemore, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/611,714

(22) Filed: Feb. 2, 2015

(65) Prior Publication Data

US 2015/0159975 A1 Jun. 11, 2015

Related U.S. Application Data

(63) Continuation of application No. 13/832,357, filed on Mar. 15, 2013, now Pat. No. 8,978,634.

(60) Provisional application No. 61/641,382, filed on May 2, 2012.

(51) Int. Cl.
*F41B 5/12* (2006.01)
*F41B 5/14* (2006.01)

(52) U.S. Cl.
CPC ..... *F41B 5/143* (2013.01); *F41B 5/12* (2013.01); *F41B 5/123* (2013.01)

(58) Field of Classification Search
CPC ..... F41B 5/123; F41B 5/12; F41B 5/143
See application file for complete search history.

(56) References Cited

U.S. PATENT DOCUMENTS

| | | | | |
|---|---|---|---|---|
| 3,224,427 | A * | 12/1965 | Ronan | 124/25 |
| 3,483,857 | A * | 12/1969 | Jones | F41B 5/12 124/25 |
| 4,716,880 | A * | 1/1988 | Adkins | 124/25 |
| 7,047,958 | B1 | 5/2006 | Colley | |
| 7,204,242 | B2 | 4/2007 | Dziekan | |
| 7,891,348 | B2 | 2/2011 | Colley | |
| 2008/0251058 | A1 | 10/2008 | Colley | |
| 2009/0101126 | A1 * | 4/2009 | Anderson | F41B 5/123 124/25 |

OTHER PUBLICATIONS

Horton—One Shot, One Choice (catalog No. 12), Horton Manufacturing Company Inc., Tallmadge, Ohio, Year: 1998, 8 pgs.
http://web.archive.org/web20050531192225/httpwww.swisscrossbow.ch/downloadstwindow_11.pdf, The Original TWINBOW II web advertisement, Swiss Crossbow Makers, 3pgs, 2005.

* cited by examiner

*Primary Examiner* — Aarti B Berdichevsky
*Assistant Examiner* — Amir Klayman
(74) *Attorney, Agent, or Firm* — Reising Ethington, P.C.

(57) ABSTRACT

A crossbow includes a barrel having a bowstring rail with a slot including spaced first and second arrow rest areas aligned along said bowstring rail and an arrow clearance area therebetween, and an arrow retention spring carried by the barrel. The first arrow rest area is positioned adjacent to an end of the bowstring rail, and the second arrow rest area is positioned beneath the arrow retention spring directly beneath said arrow retention spring in a location where said arrow retention spring is adapted to contact said arrow. Provision of the spaced rest areas, particularly the second rest area beneath the arrow retention spring, stabilizes an arrow on the barrel prior to launch.

21 Claims, 4 Drawing Sheets

FIG 5
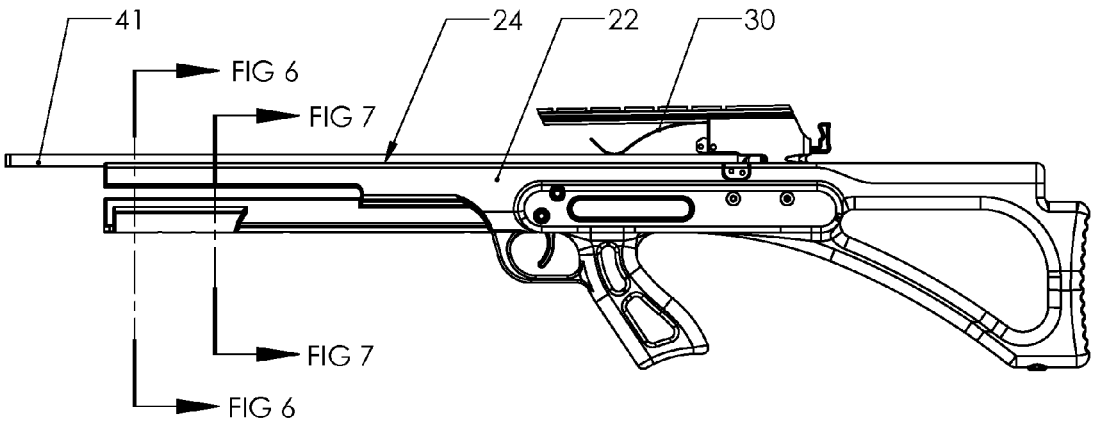
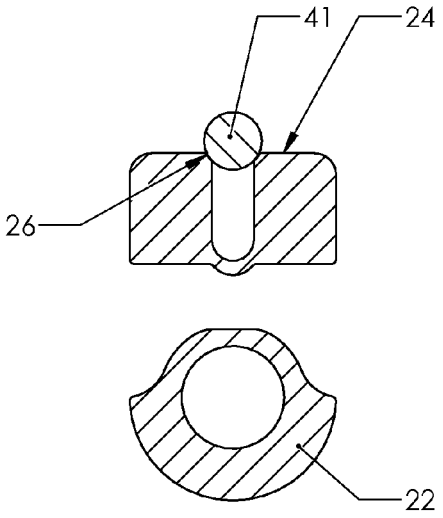
FIG 6
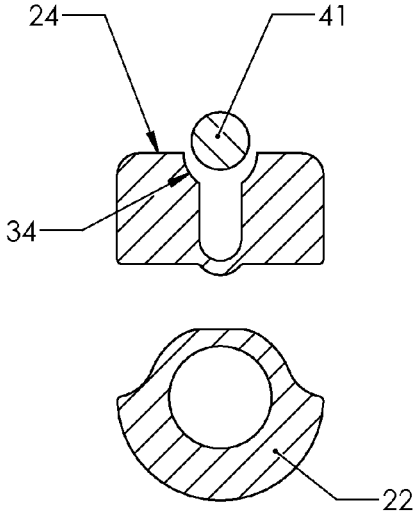
FIG 7

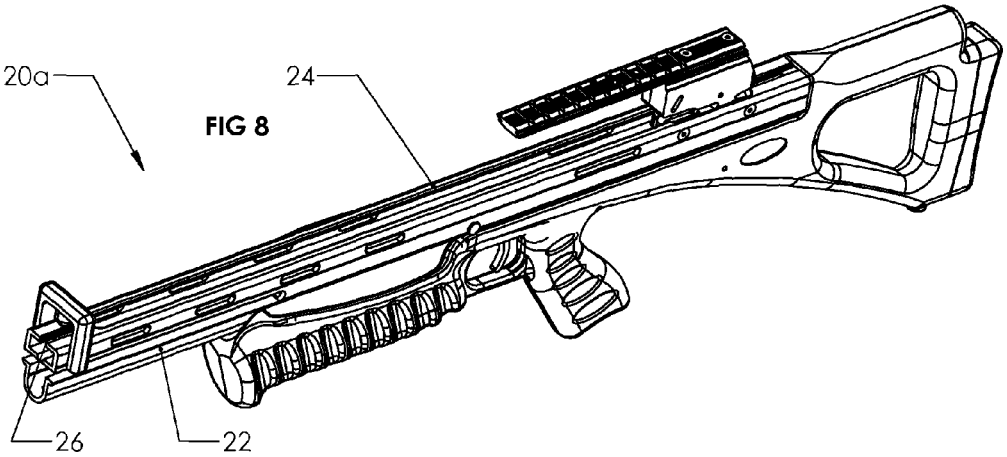
FIG 8
FIG 9
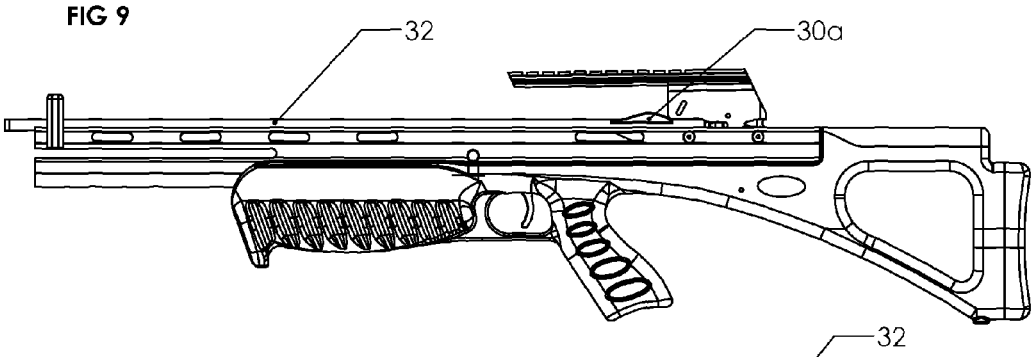
FIG 10
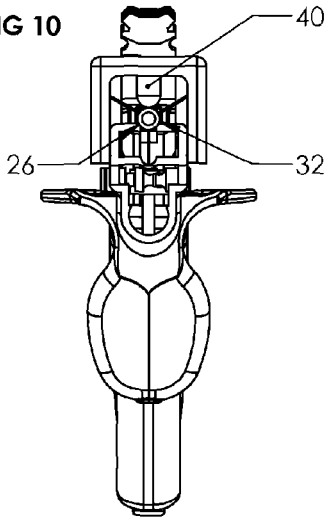
FIG 11
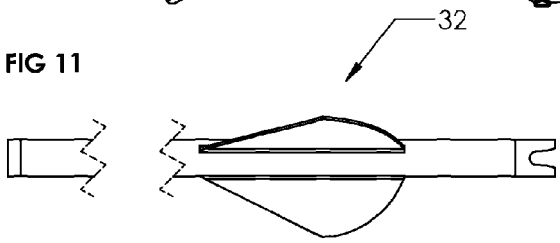
FIG 12
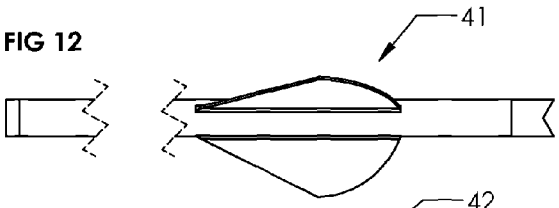
FIG 13
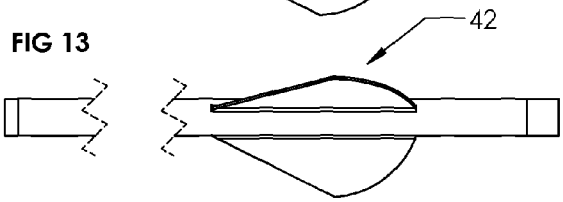

CROSSBOW WITH IMPROVED RAIL AND ARROW SLOT

This application claims priority from application No. 61/641,382 filed May 2, 2012, the disclosure of which is incorporated herein by reference.

The present disclosure is directed to crossbows, and more particularly to an improved slot on the crossbow barrel for guiding the arrow during launch.

BACKGROUND AND SUMMARY OF THE DISCLOSURE

The most popular method used by crossbows for guiding an arrow during launch is to provide a barrel that has a groove extending along the bowstring rail surface. This groove guides the arrow the entire length of the barrel during launch. An alternative technique employs a rest only at the end of the barrel opposite the bowstring. This design eliminates much of the friction during launch but does not provide desired stability.

A general object of the present disclosure is to provide a crossbow with a barrel having an arrow slot that reduces friction during launch and/or provides desired stability prior to launch and/or reduces the likelihood of a crooked barrel affecting arrow flight.

The present disclosure embodies a number of aspects that can be implemented separately from or in combination with each other.

A crossbow in accordance with one aspect of the present disclosure includes a barrel with a bowstring rail and an arrow support area on the rail. An arrow retention spring is carried by the barrel for releasably holding the arrow on the arrow support area prior to launch. The arrow support area includes a first arrow rest area adjacent to an end of the bowstring rail and a second arrow rest area beneath the arrow retention spring. An arrow on the barrel is out of contact with and spaced from the bowstring rail except in the first and second rest areas. Provision of the spaced rest areas, particularly the second rest area beneath the arrow retention spring, stabilizes an arrow on the barrel prior to launch.

BRIEF DESCRIPTION OF THE DRAWINGS

The disclosure, together with additional objects, features, advantages and aspects thereof, will best be understood from the following description, the appended claims and the accompanying drawings, in which:

FIG. 5 is a fragmentary side elevational view similar to that of FIG. 4.

FIG. 6 is a sectional view taken substantially along the line A-A in FIG. 5.

FIG. 7 is a sectional view taken substantially along the line B-B in FIG. 5.

FIG. 8 is a perspective view of a second exemplary embodiment of the disclosure with the limbs and cams removed for clarity.

FIG. 9 is a side view elevational view of the bow in FIG. 8.

FIG. 10 is an end view of the bow in FIGS. 8-9.

FIG. 11 is a fragmentary elevational view of an arrow and nock usable with the bow of FIGS. 8-10.

FIG. 12 is a fragmentary elevational view of an arrow and preferred style nock usable with the crossbow of FIGS. 1-7.

FIG. 13 is a fragmentary elevational view of an arrow and alternative style nock usable with the crossbow of FIGS. 1-7.

DETAILED DESCRIPTION OF PREFERRED EMBODIMENTS

Figure 1:
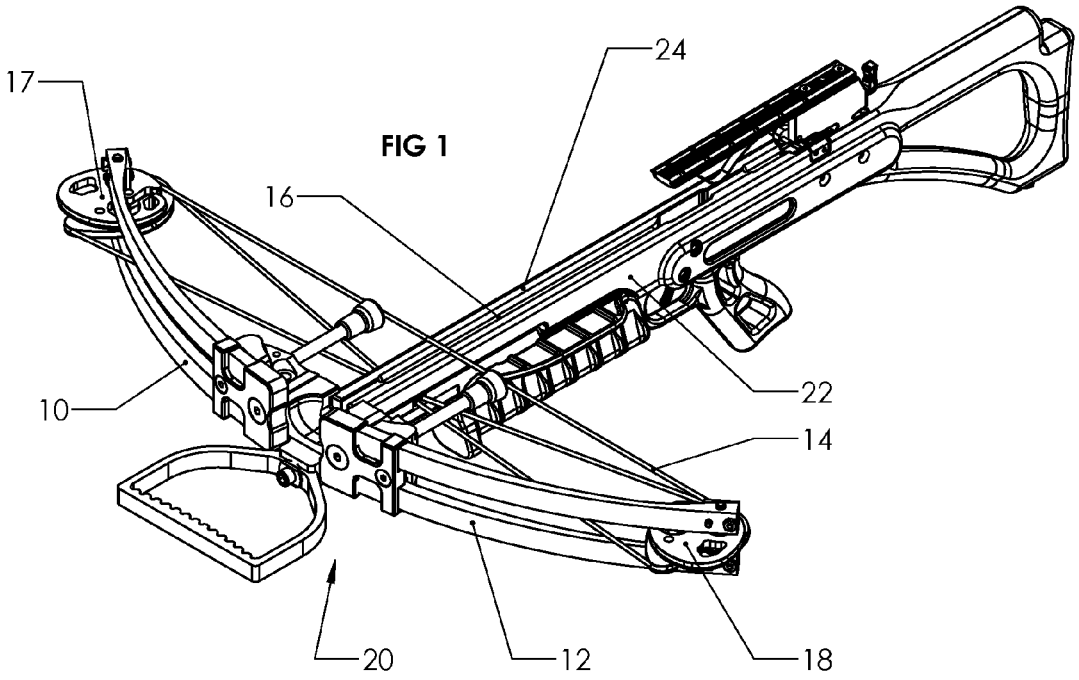
FIG. 1 is a perspective view of a crossbow in accordance with an exemplary embodiment of the present disclosure.
Figure 2:
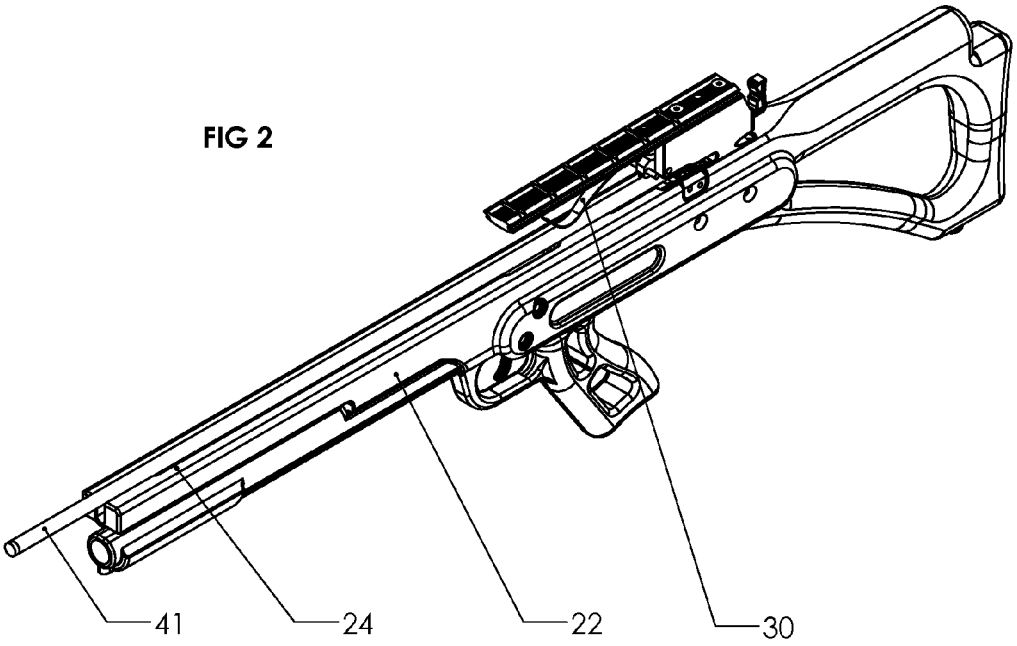
FIG. 2 is a fragmentary perspective view of the crossbow illustrated in FIG. 1.
Figure 3:
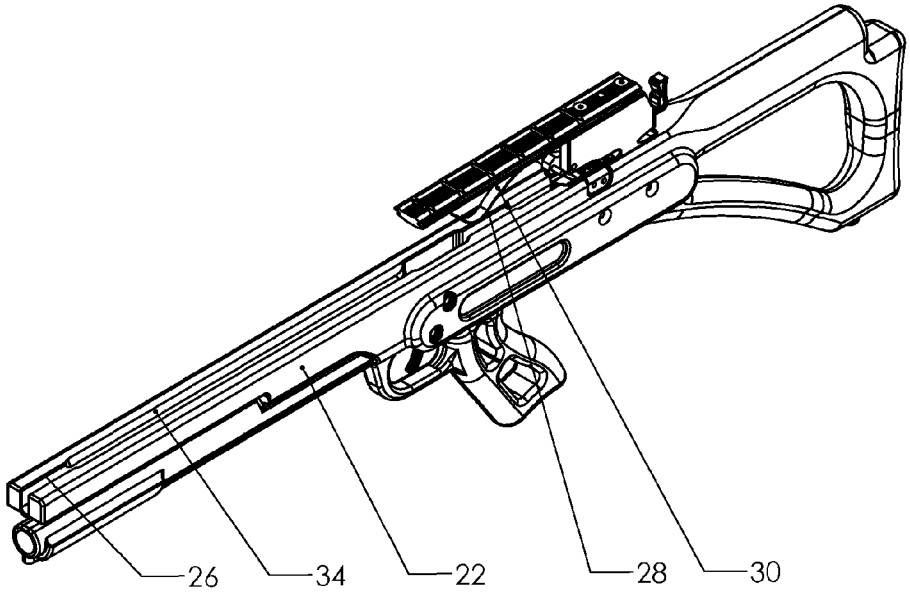
FIG. 3 is a fragmentary perspective view of the crossbow in FIGS. 1 and 2.
Figure 4:
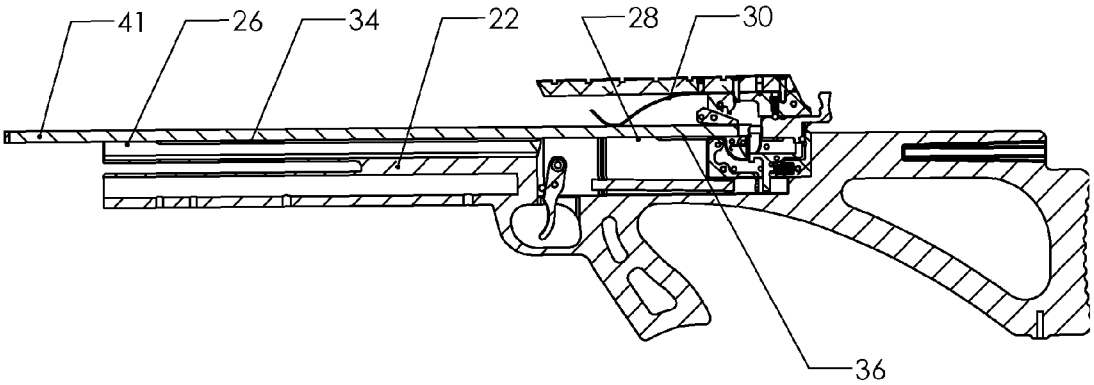
FIG. 4 is a sectional view of the crossbow in FIG. 2.

FIGS. 1-7 illustrate an exemplary crossbow 20 including flexible limbs 10, 12 mounted on a barrel 22 and having a bowstring 14 extending between the limbs. The upper surface of the barrel defines a bowstring rail 24. (Split limbs 10, 12 and the dual cams 17, 18 illustrated in FIG. 1 mounted on the limbs are exemplary only.)

The bowstring rail has a slot 16 extending along its length. This slot 16 includes spaced first and second arrow rest areas 26, 28. The first arrow rest area 26 is positioned adjacent to the end of the bowstring rail and the second arrow rest area 28 is disposed beneath an arrow retention spring 30 carried by the barrel. The exemplary spring 30 illustrated in the drawings is disclosed in U.S. application Ser. No. 13/359,558, the disclosure of which is incorporated herein by reference. Other spring configurations can be employed. Slot 16 preferably is cylindrical, at least in the spaced rest areas 26, 28. The slot in the first and second arrow rest areas preferably is of relatively small radius dimensioned to support spaced portions of the arrow 41 (typically cylindrical) prior to firing. The clearance areas 34, 36 of the slot between the rest areas and behind the second rest area are of greater dimension (they need not be cylindrical) dimensioned to be spaced from and out of contact with the arrow. (FIGS. 6 and 7 are sections through rest area 26 and clearance area 34. Sections through rest area 28 and clearance area 36 would essentially be identical to FIGS. 6 and 7.)

Thus, the arrow 41 is supported with stability at spaced rest areas 26, 28 prior to release. However, upon release, friction between the arrow and the bowstring rail is greatly reduced. Furthermore, provision of the second arrow rest area 28 beneath the arrow retention spring 30 eliminates any tendency that might otherwise occur for the spring to destabilize the arrow prior to and/or during firing. Straightness of slot 16 is less critical than if the slot were continuous, which contributes to increased accuracy. However, there is enough surface on the bowstring rail to guide the bowstring during the entire power stroke.

The sum of the first and second arrow rest areas preferably is not more than 75% of the overall length of the bowstring rail. In the illustrated embodiment of the disclosure, the first and second arrow rest areas together comprise about 20% of the overall length of the bowstring rail. The first arrow rest area adjacent to the end of the barrel preferably is shorter than the second arrow rest area beneath the arrow retention spring. In the exemplary embodiment of the disclosure, the length of the first arrow rest area is about one-half the length of the second arrow rest area. (One or both arrow rest areas 26, 28 can be interrupted to allow for assembly slots in the barrel.)

FIGS. 8-11 show a modified crossbow 20*a*, in which there is a first or forward rest area 26 adjacent to the end of the barrel, but no second rest area beneath the spring 30*a*. Rest area 26 normally would be less than 10% of the length of the bowstring rail, and could be as short one-quarter inch or as long as three inches. A retainer 40 holds the arrow against the front rest area 26. The back end of the arrow 32 is supported by the bowstring until the arrow is released.

FIGS. 11-13 illustrate various nock styles usable with the crossbows of the present disclosure.

There thus has been disclosed a crossbow that fully satisfies all of the objects and aims previously set forth. The disclosure can be implemented in both metal and molded resin barrels. The disclosure is particularly advantageous in connection with molded resin barrels because of the difficulty in molding a straight continuous arrow slot. The crossbow has been disclosed in conjunction with exemplary embodiments, and modifications and variations have been discussed. Other modifications and variations readily will suggest themselves to persons of ordinary skill in the art in view of the foregoing description. The disclosure is intended to embrace these and all other modifications and variations as fall within the spirit and broad scope of the appended claims.

The invention claimed is:

1. A crossbow that includes:

a bowstring;

a barrel having an upper surface defining a bowstring rail to guide the bowstring and with a slot including an arrow support area on the bowstring rail that includes spaced first and second arrow rest areas aligned along said bowstring rail and an arrow clearance area therebetween, and an arrow retention spring carried by the barrel, wherein the first arrow rest area is positioned adjacent to an end of the bowstring rail, and the second arrow rest area is positioned directly beneath said arrow retention spring in a location where said arrow retention spring is adapted to contact said arrow, and wherein the first and second arrow rest areas are integral portions of the bowstring rail.

2. The crossbow set forth in claim 1 wherein the first and second arrow rest areas together comprise not more than 75% of the total length of the bowstring rail.

3. The crossbow set forth in claim 2 wherein the first and second arrow rest areas together comprise about 20% of the total length of the bowstring rail.

4. The crossbow set forth in claim 1 wherein the first arrow rest area is of less length than the second arrow rest area.

5. The crossbow set forth in claim 4 wherein the first arrow rest area is about one-half the length of the second arrow rest area.

6. The crossbow set forth in claim 1 wherein said first arrow rest area comprises less than 10% of the total length of said bowstring rail, and has a length in the range of one-quarter inch to three inches.

7. The crossbow set forth in claim 1 further comprising:

an arrow on said barrel being spaced and out of contact with said barrel and said bowstring rail except in said first and second arrow rest areas, such that said arrow does not touch said bowstring rail in a clearance area between said first and second arrow rest areas.

8. A crossbow that includes:

a bowstring;

a barrel with an upper surface defining a bowstring rail to guide the bowstring and with a slot including an arrow support area along a length of and on said bowstring rail for positioning an arrow to be shot, and an arrow retention spring carried by said barrel for releasably holding an arrow on said arrow support area, characterized in that said arrow support area includes a first arrow rest area adjacent to an end of said bowstring rail, and a second arrow support area beneath said arrow retention spring and being spaced from and not connected to said first arrow rest area, wherein said first and second arrow rest areas are aligned along said bowstring rail, and wherein the first and second arrow rest areas are integral portions of the bowstring rail, wherein said second arrow support area is directly beneath said arrow retention spring in a location where said arrow retention spring contacts said arrow.

9. The crossbow set forth in claim 8 wherein said first and second arrow rest areas together comprise not more than 75% of the total length of said bowstring rail.

10. The crossbow set forth in claim 9 wherein said first and second arrow rest areas together comprise about 20% of the total length of said bowstring rail.

11. The crossbow set forth in claim 8 wherein said first arrow rest area is of less length than said second arrow rest area.

12. The crossbow set forth in claim 11 wherein said first arrow rest area is about one-half the length of said second arrow rest area.

13. The crossbow set forth in claim 8 wherein said first arrow rest area comprises less than 10% of the total length of said bowstring rail, and has a length in the range of one-quarter inch to three inches.

14. The crossbow set forth in claim 11 further comprising:

an arrow on said barrel being spaced and out of contact with said barrel and said bowstring rail except in said first arrow rest area and in said second arrow rest area.

15. A crossbow includes:

a bowstring;

a barrel with an upper surface defining a bowstring rail to guide the bowstring and with a slot including an arrow support area along a length of and on said bowstring rail for positioning an arrow to be shot, characterized in that said arrow support area includes a first arrow rest area adjacent to an end of said bowstring rail, and a second arrow rest area spaced from and not in contact with said first arrow rest area, with an arrow clearance area between the first and second arrow rest areas, wherein the first and second arrow rest areas are integral portions of the bowstring rail, and an arrow retention spring carried by said barrel for releasably holding said arrow on said second arrow rest area of said barrel, wherein said second arrow rest area is positioned directly beneath said arrow retention spring in a location where said arrow retention spring contacts said arrow, wherein said first arrow rest area comprises less than 10% of the total length of said bowstring rail, and has a length in the range of one-quarter inch to three inches.

16. The crossbow set forth in claim 15 wherein the first and second arrow rest areas are of smaller dimension than that of said arrow clearance area.

17. The crossbow set forth in claim 8 wherein the first and second arrow rest areas are of smaller dimension than that of said arrow clearance area.

18. The crossbow set forth in claim 1 wherein the first and second arrow rest areas are of smaller dimension than that of said arrow clearance area.

19. The crossbow set forth in claim 1, wherein the arrow rests are fixed, non-pivotal, and the only arrow rest areas of the crossbow.

20. The crossbow set forth in claim 8, wherein the arrow rests are fixed, non-pivotal, and the only arrow rest areas of the crossbow.

21. The crossbow set forth in claim 15, wherein the arrow rests are fixed, non-pivotal, and the only arrow rest areas of the crossbow.

* * * * *